United States Patent [19]

Brooks

[11] 4,174,078

[45] Nov. 13, 1979

[54] TAPE TENSIONING APPARATUS PARTICULARLY USEFUL IN PRINTING APPARATUS

[75] Inventor: Robert J. Brooks, Woodinville, Wash.

[73] Assignee: Interface Mechanisms, Inc., Lynnwood, Wash.

[21] Appl. No.: 951,624

[22] Filed: Oct. 16, 1978

[51] Int. Cl.[2] ..... B65H 25/22; B65H 59/38

[52] U.S. Cl. ..... 242/75.43; 242/156.2

[58] Field of Search ..... 242/75, 75.43, 45, 156.2, 242/67.4

[56] References Cited

U.S. PATENT DOCUMENTS

| | | | |
|---|---|---|---|
| 1,809,940 | 6/1931 | Kronmiller | 242/156.2 |
| 2,766,945 | 5/1963 | Purzycki | 242/45 |
| 3,222,008 | 12/1965 | Purzycki | 242/75.43 |
| 3,866,851 | 2/1975 | Brooks | 242/156.2 |
| 3,949,949 | 4/1976 | Thompson | 242/75.43 |

*Primary Examiner*—Edward J. McCarthy
*Attorney, Agent, or Firm*—Christensen, O'Connor, Johnson & Kindness

[57] ABSTRACT

A tape tensioning apparatus particularly useful in regulating the tension in a tape such as an elongated strip of printer ribbon stock used in printing apparatus such as mechanical impact printers. A stock guide is supported for rotation on a base, the stock guide having an arm from which extends a roller. An inclined surface on the stock guide rests on a complementary inclined surface on the base so that the stock guide moves toward the base as the stock guide is rotated in a predetermined direction from a predetermined angular position, with a spring yieldably biasing the stock guide to its predetermined angular position. A spool of print or ribbon stock is mounted on a reel, itself supported for rotation with respect to the base, with the stock passing around the roller on the stock guide after exiting from the spool thereof and with the reel resting on and rotatable with a reel support disc which is constrained from moving more than a predetermined distance above the base. A compressible, resilient O-ring is located between the reel support disc and the stock guide and is fully compressed therebetween when the stock guide is in its predetermined angular position so as to inhibit rotation of the reel support disc and the reel wit respect to the stock guide. As a force is exerted by the printing apparatus on the stock to draw the stock from the spool thereof, the stock guide rotates away from its predetermined angular position and moves toward the base to progressively decompress the O-ring to eventually permit the reel support disc and the reel to rotate with respect to the stock guide. The stock guide and base are also provided with complementary surfaces adjoining the inclined surfaces thereof which define maximum and minimum elevations of the stock guide above the base which may be used to detect abnormally low tension and abnormally high tension conditions in the print or ribbon stock.

16 Claims, 9 Drawing Figures

TAPE TENSIONING APPARATUS PARTICULARLY USEFUL IN PRINTING APPARATUS

FIELD OF THE INVENTION

This invention generally relates to the field of tape tensioning apparatus, and, more particularly, to a tape tensioning apparatus particularly useful in regulating the tension in a tape such as an elongated strip of print or ribbon stock used in printing apparatus such as mechanical impact printers.

BACKGROUND OF THE INVENTION

Mechanical impact printers are known to the prior art for imprinting a succession of characters, which may be expressed in the form of a bar code or the like, on an elongated strip of print stock. In such printers, the elongated strip of print stock is caused to substantially continuously move along a predetermined path by being drawn from a spool thereof mounted on a rotatable, print stock supply reel, guided to a print station where the characters are successively printed, and guided to and passed between a rotating, print stock drive capstan and associated pinch roller. An elongated strip of ribbon stock is also caused to substantially continuously move along a predetermined path by being drawn from a spool thereof mounted on a rotatable, ribbon stock supply reel, guided to the print station, and guided to and passed between a rotating, ribbon stock drive capstan and associated pinch roller.

In order to insure proper operation for the impact printer, both the print stock and the ribbon stock must be maintained under substantially constant tension as they are moved along their respective predetermined paths to and from the print station. If the stock tension is too high, then the stock is likely to break or tear. Conversely, if the stock tension is too low, then the stock may shift during imprinting, resulting in a lack of accuracy and precision in the imprinted characters.

The prior art, as typified by U.S. Pat. No. 3,866,851, Brooks, issued on Feb. 18, 1975 to the assignee of the present invention, teaches apparatus for regulating the tension in an elongated strip of print or ribbon stock. Such prior art apparatus includes a lever arm which is supported for rotation about an axis proximate to a rotatable spindle supporting the stock supply reel. A roller is provided on an end of the lever arm away from its axis of rotation, with the elongated strip of stock passing around the roller after being drawn from a spool thereof mounted on the stock supply reel. A spring biases the lever arm to a predetermined angular position, and a braking means is responsive to rotation of the lever arm from its predetermined angular position for varying a braking force applied to the spindle. The braking force is at a maximum when the lever arm is in its predetermined angular position, and decreases as the lever arm is rotated away from that predetermined angular position.

In operation, movement of the elongated strip of stock along its predetermined path causes the lever arm to rotate toward the direction of stock movement and against the force of its associated spring. As the lever arm continues to rotate, the braking force exerted on the spindle is progressively reduced so that the stock supply reel rotates relative to the lever arm to permit the elongated strip of stock to be drawn out. Those skilled in the art will appreciate that the tension in the elongated strip will first increase and then progressively decrease as the stock supply reel rotates relative to the lever arm. Rotation of the lever arm toward the direction of stock movement continues until an equilibrium position, representing the desired stock tension, is reached at which the force exerted on the elongated strip by the spring of the lever arm is balanced by the braking force exerted on the spindle. Thereafter, the prior art tensioning apparatus will attempt to maintain the stock tension at the desired value thereof, e.g., a decrease in stock tension will cause the lever arm to rotate back toward its predetermined angular position to increase the braking force applied to the spindle so as to increase the stock tension.

The tensioning apparatus of the prior art, although providing acceptable operation in most applications, includes an assembly of quite a number of springs, arms, cams, and brake arms, as can be seen from a review of the aforementioned U.S. Pat. No. 3,866,851. Such an assembly is not very compact and cannot be used in certain applications in which space is at a premium. Because of the number of components involved, the assembly is also relatively expensive to manufacture, install and adjust.

It is therefore an object of this invention to provide an improved apparatus for regulating the tension in a tape such as an elongated strip of print or ribbon stock used in printing apparatus.

It is a further object of this invention to provide such a tensioning apparatus which can be constructed as an assembly from a minimum number of components and which accordingly is inexpensive to manufacture and to install.

It is yet a further object of this invention to provide such a tensioning apparatus which is relatively easy to adjust for proper operation, once installed, and which does not require readjustment during continued operation thereof.

It is another object of this invention to provide such a tensioning apparatus which, in addition to regulating the tension in the tape at a substantially constant value, also includes components for positively and repeatably indicating abnormally high and abnormally low values of tape tension.

It is yet a further object of this invention to provide a tensioning apparatus which is compact and which accordingly can be used in applications in which space is at a premium.

SUMMARY OF THE INVENTION

The foregoing objects, as well as additional objects and advantages that will be apparent to those of ordinary skill in the art, are achieved in an apparatus for dispensing tape from a spool thereof and for regulating the tension of the tape so dispensed at a substantially constant value. A first means is adapted to receive the spool, the first means being supported for rotation about a first axis. A second means is supported for rotation about a second axis which is proximate to and substantially parallel to the first axis, the second means including a tape guide which is adapted to engage a portion of the tape exiting from the spool, whereby the second means may be caused to rotate in a predetermined direction about the second axis by forces exerted on the tape which tend to draw the tape from the first means. A third means exerts a rotational force on the second means so as to yieldably bias the second means to a predetermined angular position thereof. A compressible, resilient member is located between the first and the second means and is capable of being compressed therebetween. A fourth means is provided for varying the displacement between the first means and the second means, in an axial direction substantially parallel to the first and second axes, as the angular position of the second means is varied. The displacement is at a minimum when the second means is at its predetermined angular position so that the compressible, resilient member is fully compressed to substantially inhibit rotation of the first means relative to the second means. The displacement progressively increases as the second means is caused to rotate away from its predetermined angular position so that the compressible, resilient member is progressively decompressed to permit rotation of the first means relative to the second means.

In a preferred embodiment, the fourth means includes means constraining the first means from moving above a predetermined elevation in the axial direction. First and second, contacting, opposing surfaces are provided for varying the elevation of the second means in the axial direction, the first surface being joined to and rotatable with the second means and the second surface having a fixed elevation in the axial direction. At least one of the first and second surfaces slopes away from the first means in the predetermined direction of rotation of the second means from its predetermined angular position.

BRIEF DESCRIPTION OF THE DRAWINGS

The invention can best be understood by reference to the following portion of the specification, taken in conjunction with the accompanying drawings, in which.

DESCRIPTION OF A PREFERRED EMBODIMENT

Figure 1:
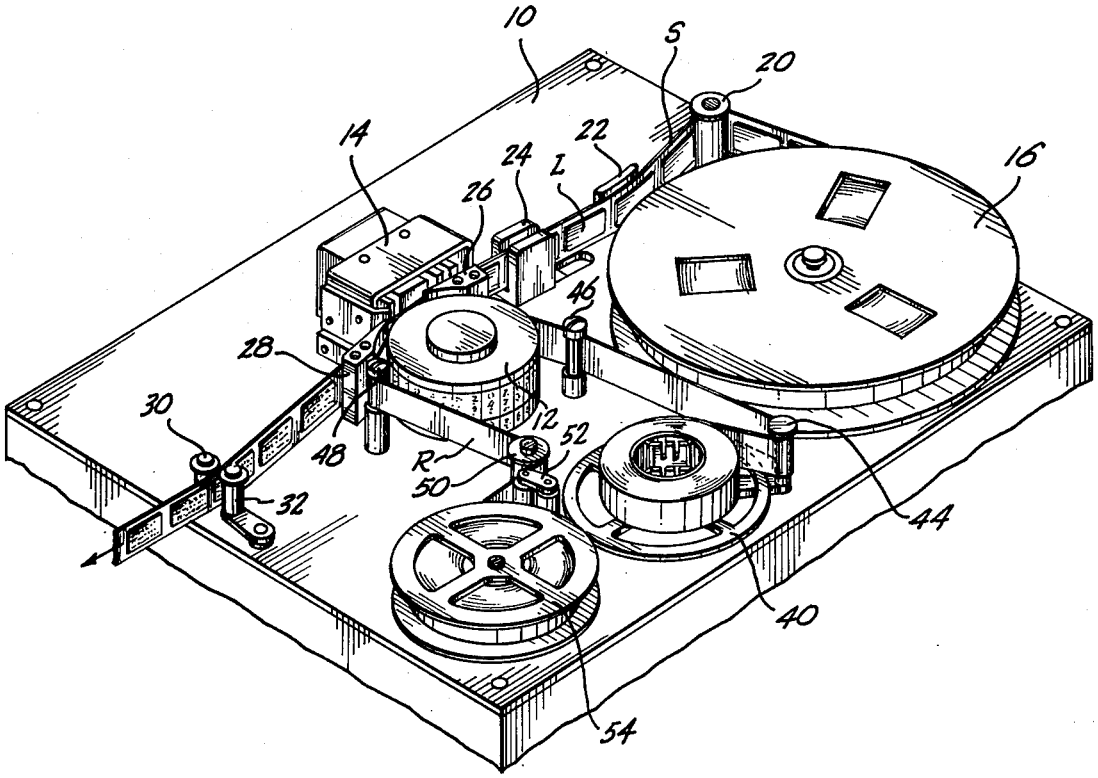
FIG. 1 is a pictorial view of an impact printer including the improved tensioning apparatus of the present invention.

Referring now to FIG. 1, an impact printer includes a base plate 10 above which a print wheel 12 is supported for rotation. The circumferential surface of print wheel 12 has located thereon a plurality of raised elements representing the characters to be imprinted, with the print wheel 12 being continuously rotated by a drive means, not illustrated. A hammer mechanism 14 is located in proximity to the print wheel 12 and together with print wheel 12 forms a print station. The hammer mechanism 14 includes at least one hammer which is capable of a controllable, substantially reciprocative movement whereby a hammer face thereof impacts a back surface of an elongated strip of label stock backing S to press one of a plurality of labels L, removably adhering to a front surface of the backing S, and an interposed elongated strip of ribbon stock R against one of the raised elements on the print wheel 12 to thereby imprint a character on the label L.

The print stock, including the label stock backing S, is obtained from a print stock supply reel 16 which is supported for rotation above base plate 10. From the print stock supply reel 16, the print stock is first drawn around a tension roller 20, and from there moves in a predetermined path past a guide member 22, a stock sensor 24, and a guide member 26 to the print station. Immediately after leaving the print station, the print stock moves in a predetermined path by being drawn over a guide member 28 and thereafter is pressed against a drive capstan 30 by an associated pinch roller 32, and then exits from the impact printer. Drive capstan 30 is rotated by a drive capstan motor, not illustrated, mounted below the base plate 10. During its passage through the impact printer from the print stock supply reel 16 to the drive capstan 30, the print stock is maintained under tension by the tension roller 20 acting against the force exerted on the print stock by the drive capstan 30.

The elongated strip of ribbon stock R is obtained from a ribbon stock supply reel 40 which is supported for rotation above base plate 10. From the ribbon stock supply reel 40, the ribbon stock R passes around a tension roller 44 and around a guide pin 46 to the print station. Immediately after leaving the print station, the ribbon stock R passes around a guide pin 48 and thereafter is pressed against a drive capstan 50 by an associated pinch roller 52, and then is taken up on a ribbon take-up reel 54 which is rotated by a ribbon drive motor, not illustrated. During its passage through the impact printer from the ribbon stock supply reel 40 to the drive capstan 50, the ribbon stock R is maintained under tension by the tension roller 44 acting against the force exerted on the ribbon stock R by the drive capstan 50.

As is conventional in the prior art, electronic control means is provided for controlling and coordinating the rotation of drive capstans 30, 50 to provide movement of the print stock and the ribbon stock through the print station. Electronic control means is likewise provided for coordinating the movement of the hammer within the hammer mechanism 14 with the rotation of print wheel 12 under control of timing signals obtained from print wheel 12 to provide imprinting of selected characters in succession on the labels L removably adhering to the label stock backing S.

The embodiment of the present invention to be described is associated with and includes the tension roller 44 and the ribbon stock supply reel 40, and is particularly adapted to regulate the tension in the elongated strip of ribbon stock R as it is drawn from the reel 40. The invention is not limited thereto, however, and can be used in conjunction with practically any tape, such as the print stock including label stock backing S, for regulating the tension in the tape as it is drawn from a supply reel thereof.

Figures 2, 3:
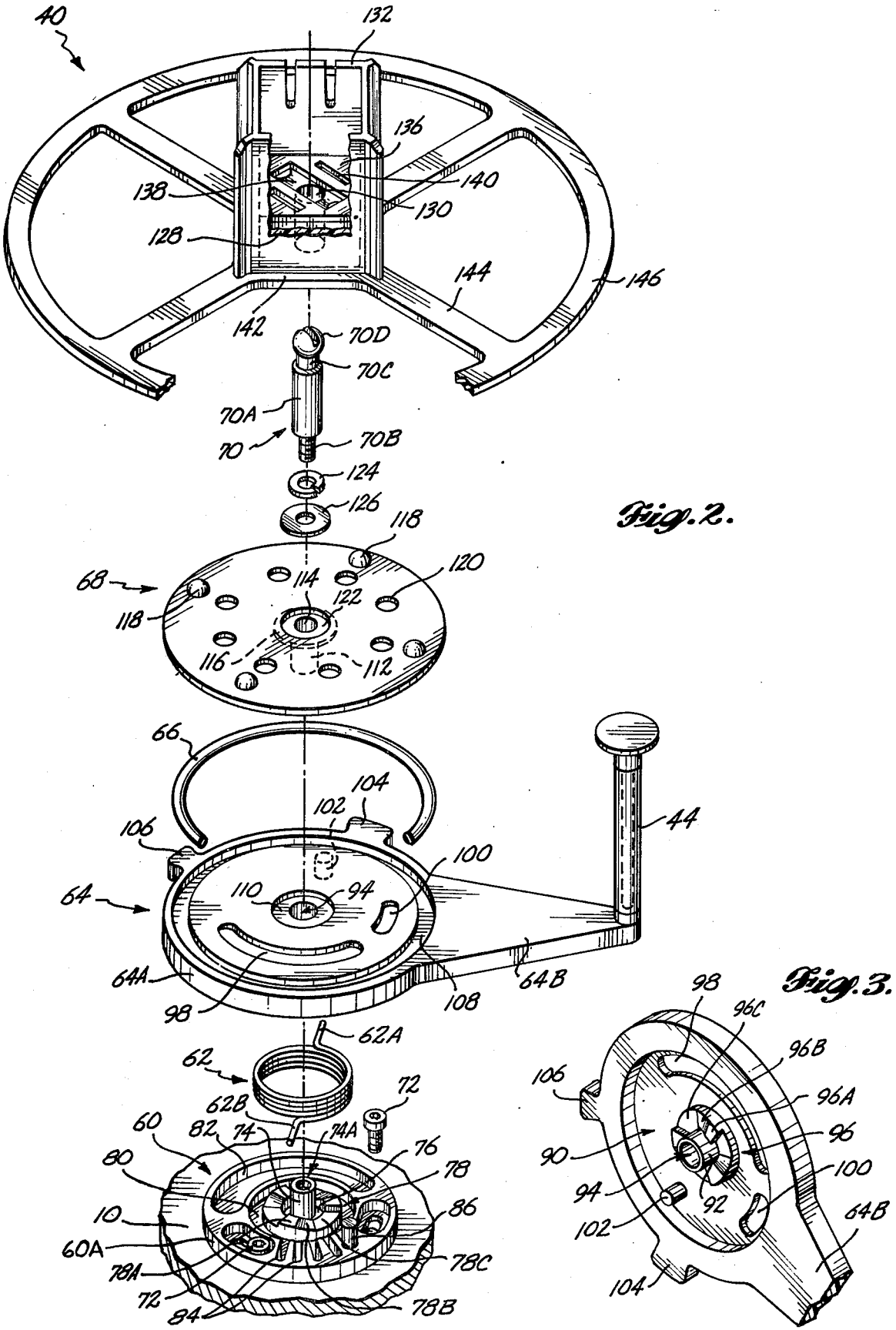
FIG. 2 is an exploded, pictorial view of the components of the improved tensioning apparatus.
FIG. 3 is a pictorial view of a portion of a roller support comprising one of the components of the improved tensioning apparatus.

With reference now to FIG. 2, the major components of the tensioning apparatus include a base 60, a coil spring 62, a tape or stock guide 64, an O-ring 66, a reel support disc 68, and a shaft 70 about which the ribbon stock supply reel 40 is supported for rotation.

The base 60 has a substantially cylindrical, peripheral surface 60A and is secured to the base plate 10 by a pair of fasteners 72. A central, substantially cylindrical projection 74 extends above base 60. A first annular groove 76, an annular projection 78, a second annular groove 80 and an arcuate recess 82 are located in base 60 concentric with projection 74 and in order of increasing radii therefrom. A plurality of radially-spaced notches 84 extend into base 60 from second annular groove 80 at a location generally opposite to that of arcuate recess 82. Second annular groove 80 is dimensioned so as to receive the body of the coil spring 62 so that a first radially-extending end 62A of coil spring 62 overlies arcuate recess 82 and a second radially-extending end 62B thereof is received in one of the plurality of notches 84.

Figure 5:
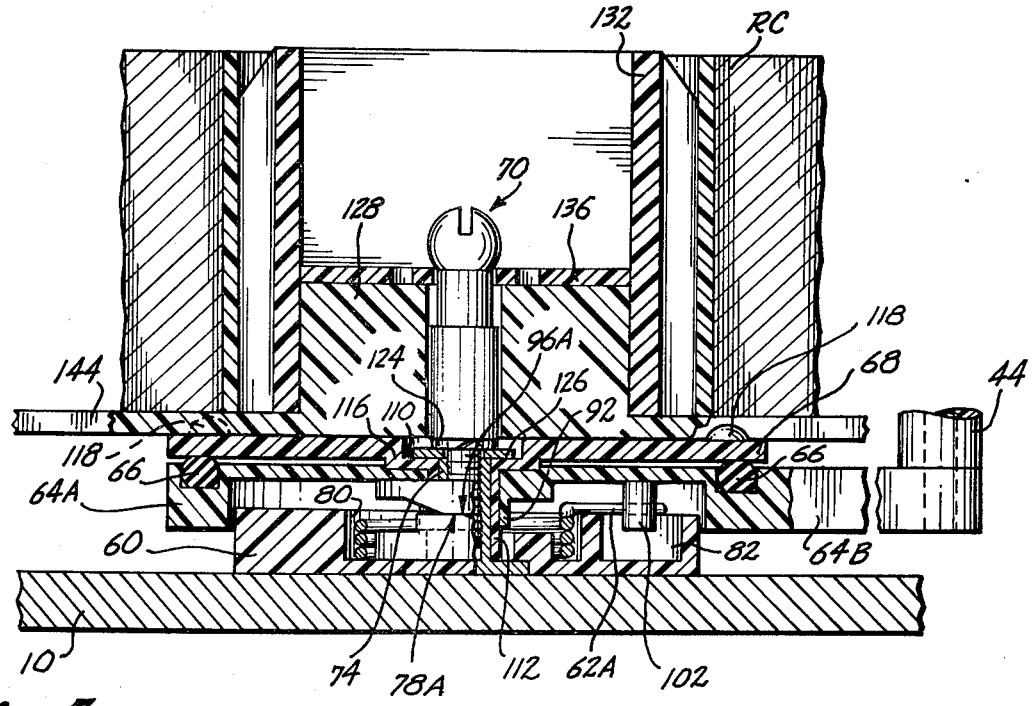
FIG. 5 is a cross sectional view of the improved tensioning apparatus, taken along the line 5—5 in FIG. 4.
Figure 7:
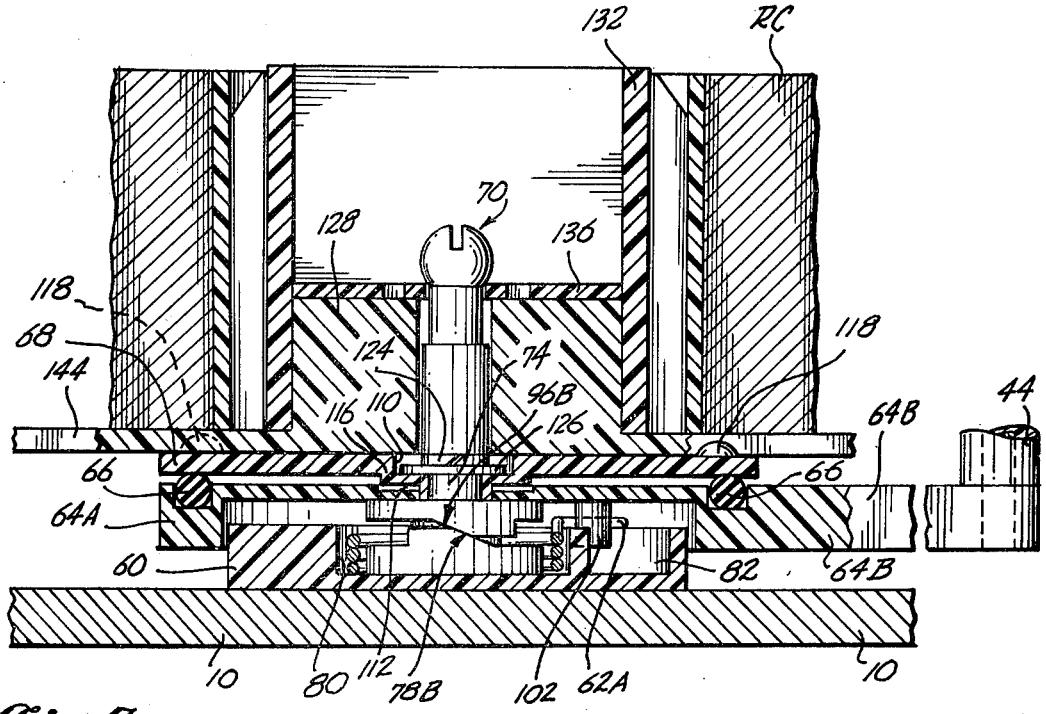
FIG. 7 is a cross sectional view of the improved tensioning apparatus taken along the line 7—7 of FIG. 6.
Figure 9:
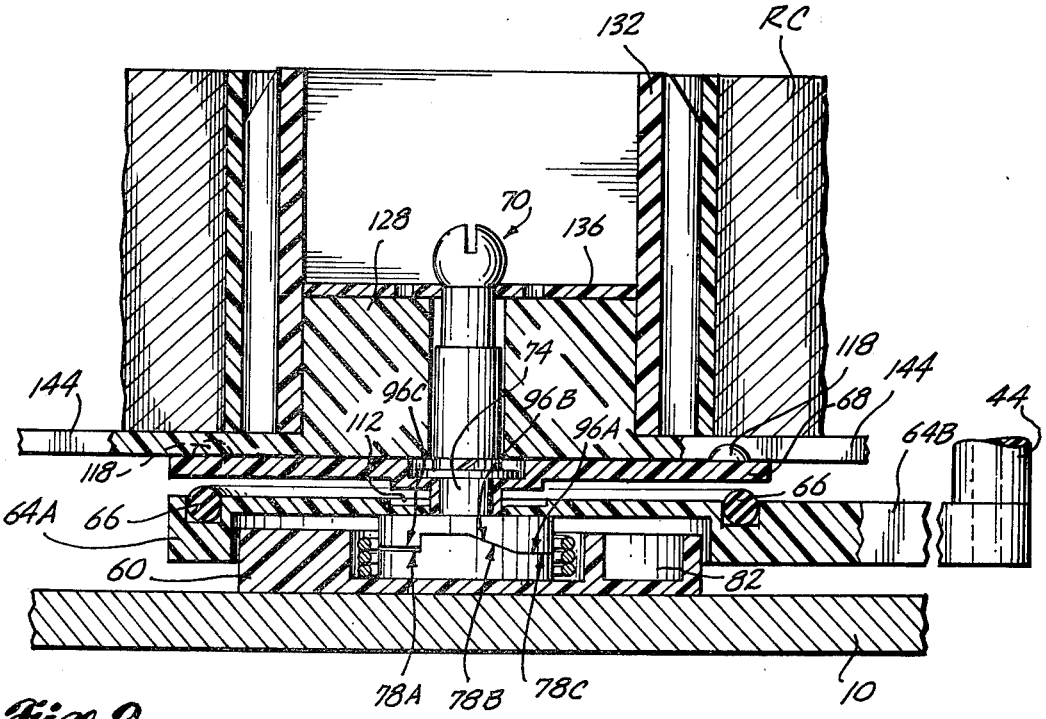
FIG. 9 is a cross sectional view of the improved tensioning apparatus, taken along the line 9—9 in FIG. 8.

The annular projection 78 has three identical sets of surfaces 78A, 78B and 78C, each set subtending a radial angle of approximately 120°. In each set, the surfaces 78A, 78C are substantially planar and are substantially perpendicular to the longitudinal axis of projection 80. As best seen in FIGS. 5, 7 and 9, the surface 78A is located at a greater distance from the floor of annular groove 76 than is surface 78C. Surface 78B, which is located intermediate surfaces 78A and 78C, is also substantially planar but is inclined from surface 78A to surface 78C. By way of example only, surfaces 78A and 78B each subtend a radial angle of approximately 30°, while surface 78C subtends a radial angle of approximately 60°. The base 60 is completed by a pin 86 upstanding therefrom in proximity to the notches 84.

The guide 64 includes a disc-like portion 64A and an arm 64B extending therefrom and supporting in turn the tension roller 44. With particular reference to FIG. 3, the disc-like portion 64A has located, in a lower surface thereof, a cylindrical recess 90 whose diameter is slightly greater than that of peripheral surface 60A of base 60 (FIG. 2). A central, substantially cylindrical projection 92 extends from the floor of recess 90 and has a cylindrical aperture 94 therein extending to the top surface of disc-like portion 64A (FIG. 2). The diameter of aperture 94 is somewhat larger than the outside of projection 74, and the outside diameter of projection 92 is chosen to be slightly less than the outside diameter of first annular groove 76 so that projection 92 may fit into first annular groove 76. Surrounding and concentric with projection 92 is an annular projection 96 whose inside and outside diameters correspond to those of annular projection 78 and which has three sets of surfaces 96A, 96B and 96C, each set subtending a radial angle of approximately 120°. In each set, the surfaces 96A and 96C are substantially planar and are substantially perpendicular to the longitudinal axis of projection 92, with surface 96A being located at a greater distance from the floor of recess 90 than surface 96C. Surface 96B, which is located intermediate surfaces 96A and 96C, is also substantially planar but is inclined from surface 96A to surface 96C. By way of example only, surfaces 96A, 96B each subtend a radial angle of approximately 30°, while surface 96C subtends a radial angle of approximately 60°.

As can be appreciated from the foregoing description, surfaces 96A, 96B and 96C are generally complementary to surfaces 78A, 78B and 78C so that when the guide 64 is assembled with the base 60, surfaces 96A, 96B and 96C are capable of resting on certain ones of the surfaces 78A, 78B and 78C as explained hereinafter.

Also located in the disc-like portion 64A are arcuate apertures 98, 100, each of which is concentric with projection 92 and extends from the floor of recess 90 to the upper surface of disc-like portion 64A (FIG. 2). The radius of arcuate aperture 98, from the longitudinal axis of projection 92, is chosen to be substantially equal to the radius of pin 86 from projection 74 in base 60. A projection 102 is also located in recess 90 at a radius, from the longitudinal axis of projection 92, which substantially corresponds to the radius of arcuate recess 82 from projection 74 in base 60. In assembly, pin 86 is received in arcuate aperture 98, and pin 102 is received in arcuate recess 82. In addition, pin 102 bears against the radial end 62A of coil spring 62, with the result that guide 64 is yieldably biased to a rest position (FIG. 4) which is determined by the engagement of pin 86 with one end of arcuate aperture 98. Guide 64 is capable of counter clockwise rotation, against the force of the coil spring 62, from its rest position through a range of "low tension" angular positions, then through a range of intermediate or "substantially constant tension" angular positions (FIG. 6), and finally through a range of "high tension" angular positions (FIG. 8), to a limiting position which is determined by the engagement of pin 102 with one end of arcuate aperture 82. The arcuate apertures 98, 100 in the guide 64 also permit access to be made to the fasteners 72 in the base 60 so that the guide 64, the coil spring 62, and the base 60 can be installed and removed without the necessity of disassembly thereof.

A pair of radially-spaced nibs 104, 106 project from the periphery of disc-like portion 64A for purposes to be hereinafter described. An annular groove 108 is located in an upper surface of the disc-like portion 64A for receiving the O-ring 66. The annular groove 108 is concentric with the longitudinal axis of aperture 94, as is a central recess 110 also located in the upper surface of disc-like portion 64A and immediately adjacent aperture 94. As best seen in FIG. 9, the O-ring 66, which is of a compressible, resilient material, has a cross sectional diameter that is greater than the depth of annular groove 108 so that a portion of the O-ring 66, when uncompressed, extends above the upper surface of disc-like portion 64A.

The reel support disc 68 has a central, substantially cylindrical projection 112 depending from a lower surface thereof. A substantially cylindrical aperture 114 extends through projection 112 to the upper surface of reel support disc 68. The outside diameter of projection 112 is chosen to be slightly less than the diameter of aperture 94 in guide 64, and the diameter of aperture 114 is chosen to be slightly greater than the outside diameter of projection 74 in base 60. In addition, projection 112 is surrounded by a concentric, annular projection 116 whose outside diameter is chosen to be slightly less than the diameter of recess 110 in guide 64. Accordingly, when reel support disc 68, O-ring 66, guide 64, coil spring 62, and base 60 are assembled, the projection 112 passes through aperture 94 and fits over projection 74, with the lower surface of projection 112 resting on the floor of first annular groove 76 in base 60 and with the annular projection 116 being received in recess 110 of guide 64. The O-ring 66 is therefore positioned so as to be compressed between the lower surface of reel support disc 68 and the floor of the annular groove 108 in guide 64. The upper surface of projection 74 also passes through the aperture 94 in guide 64 and the aperture 114 in reel support disc 68 and extends above the floor of a central recess 122 located in the upper surface of reel support disc 68 and concentric with the aperture 114 therein (FIGS. 5, 7 and 9).

The reel support disc 68 has a plurality of radially spaced projections 118 located on its upper surface near the periphery thereof for providing a driving force to the stock supply reel 40. A plurality of radially spaced apertures 120 extend through reel support disc 68 and have a common radius, from the longitudinal axis of aperture 114, which substantially corresponds to the radius of arcuate apertures 98, 100 in guide 64, for permitting access to the fasteners 72 in base 60 so that the entire tensioning apparatus can be installed and removed without the necessity of disassembly. The tensioning apparatus is completed by the shaft 70 which includes a central shaft portion 70A. A threaded shaft 70B depends from one end of central shaft portion 70A, and passes through a lock washer 124, a washer 126 which fits into central recess 122 in reel support disc 68, and into a corresponding threaded aperture 74A in projection 74 of base 60. Since the upper surface of projection 74 in assembly extends above the floor of the recess 122 in reel support disc 68, it can be seen that shaft 70 can be rigidly secured to the projection 74 to accordingly define an axis of rotation for the stock supply reel 40, but does not inhibit rotation of the reel support disc 68 whose minimum elevation above the base 60 is established by contact between the lower surface of the projection 112 and the floor of the first annular groove 76 in base 60 and whose maximum elevation above the base 60 is established by contact between the floor of recess 122 and the lower surface of washer 126. The guide 64, however, is capable of movement in an axial direction perpendicular to the plane of rotation thereof so as to vary the forces of compression exerted on O-ring 66, as will be explained in detail hereinafter.

Figure 4:
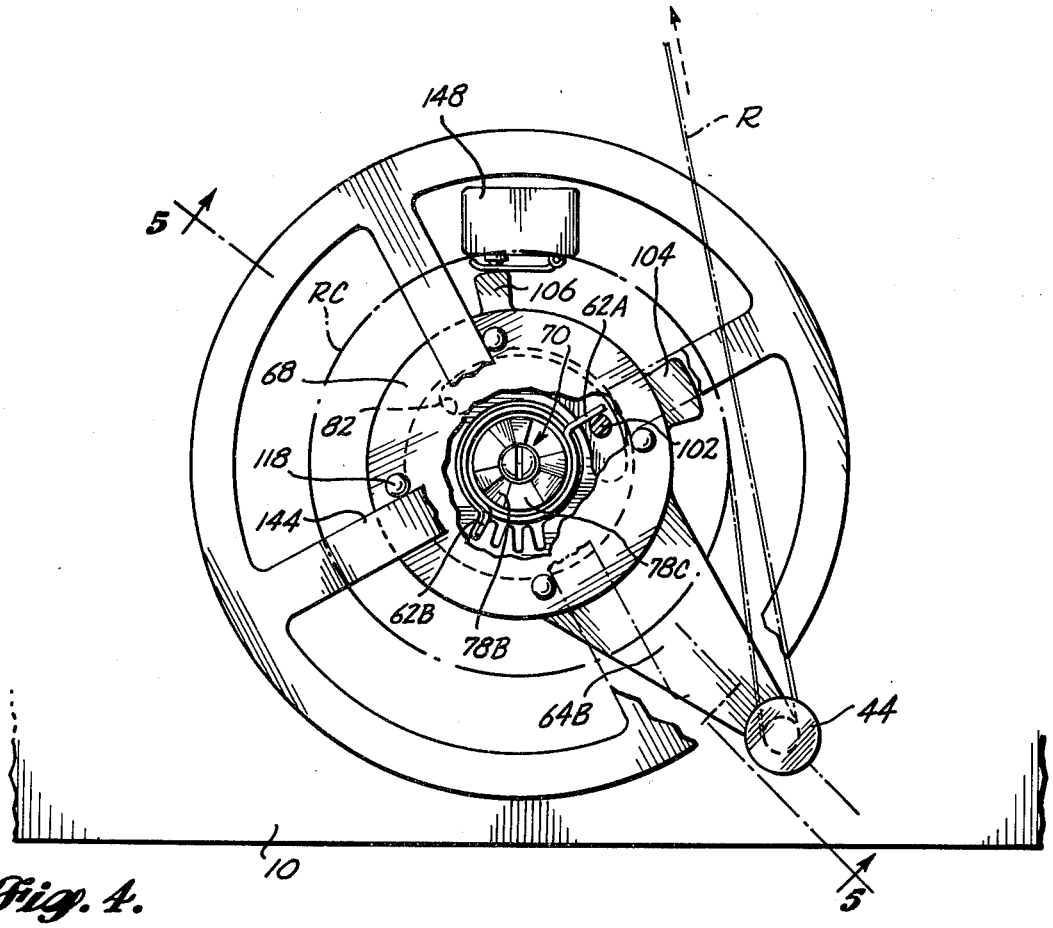
FIG. 4 is a top plan view of the improved tensioning apparatus, under a condition of abnormally low tape tension.
Figure 8:
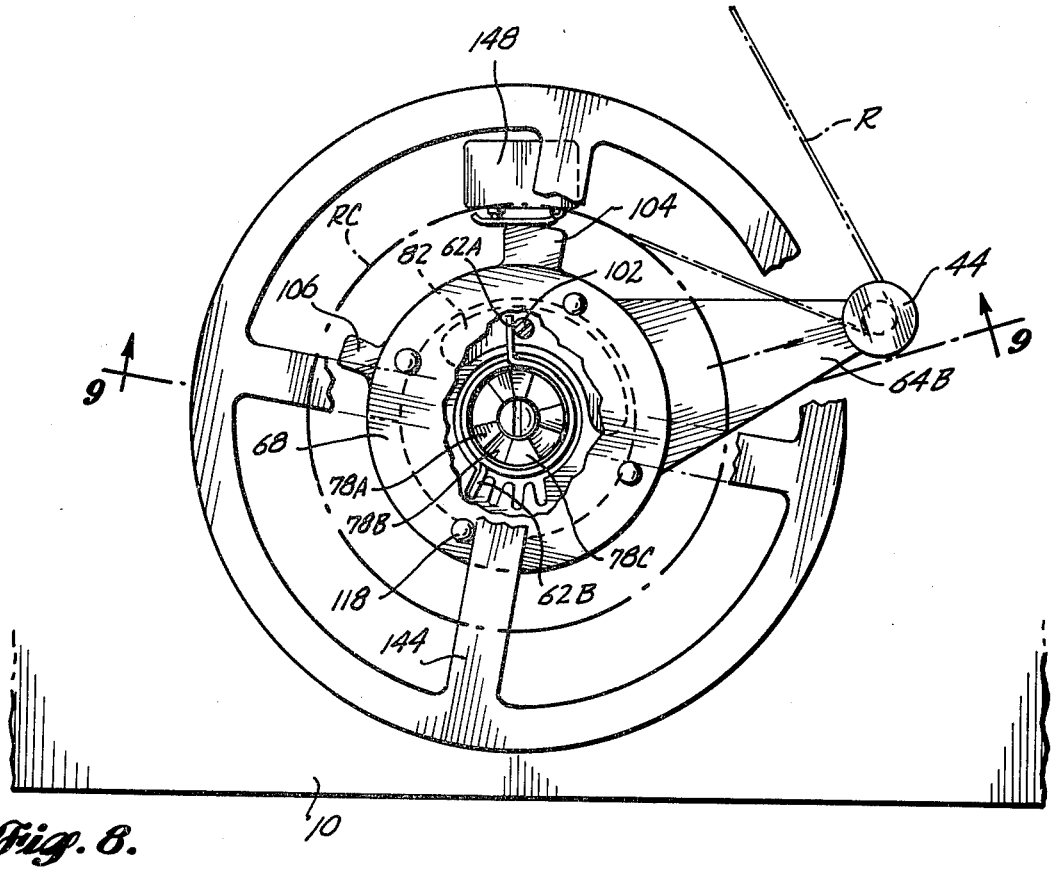
FIG. 8 is a top plan view of the improved tensioning apparatus, under a condition of abnormally high tape tension.

The stock supply reel 40 includes a core 128 which has a central, cylindrical aperture 130 therein configured to receive the central portion 70A of shaft 70. The core 128 is surrounded by a plurality of orthogonal walls 132 which can be inserted in the central aperture of a spool of tape such as ribbon or print stock, not illustrated in FIG. 2. A plate 136 is located within the walls 132 and is secured adjacent the top surface of the core 128, with the plate 136 having a central, substantially rectangular aperture 138 aligned with the aperture 130 in core 128, and a pair of adjacent relief slots 140 which, together with rectangular aperture 138, define a pair of deflectable beams. Extending from a second end of the central portion 70A of the shaft 70 is a reduced diameter portion 70C and an adjacent enlarged head portion 70D. When the stock supply reel 40 is installed on the tensioning apparatus, the beams in the plate 136 initially are deflected outwardly by the enlarged head portion 70D, and then snap inwardly to engage the reduced diameter portion 70C so as to retain the stock supply reel 40 on the tensioning apparatus. The stock supply reel 40 is completed by a hub 142 attached to the core 128, the hub 142 having a plurality of radial arms 144 which terminate in a rim 146. When the stock supply reel 40 is installed on the tensioning apparatus, the radial arms 144 rest on the upper surface of the reel support disc 68 and contact respective ones of the plurality of projections 118 (FIGS. 4, 6 and 8).

In use, a spool of ribbon stock R is placed on the stock supply reel 40. The free end of the ribbon stock R is then passed around the tension roller 44, the guide pin 46, through the print station, around the guide pin 48, between the drive capstan 50 and its associated pinch roller 52, and attached to the take-up reel 54, as illustrated in FIG. 1. Before rotation of the drive capstan 50 commences, the ribbon stock R will be under substantially low tension, with the result that the guide 64 is at its rest position as illustrated in FIGS. 4 and 5. As particularly shown in FIG. 5, the surfaces 96A of the guide 64 rest on the surfaces 78A of the base 60. Accordingly, the O-ring 66 is fully compressed between the reel support disc 68 and the guide 64, with the amount of compression being predetermined by engagement of the lower surface of annular projection 116 on reel support disc 68 with the floor of central recess 110 in guide 64 so as to inhibit rotation of reel support disc 68, and therefore of stock supply reel 40, with respect to guide 64. Initial rotation of drive capstan 50 causes the roller 44 to move in the direction of ribbon stock movement, or toward the guide pin 46, so that guide 64 and therefore reel support disc 68 and stock supply reel 40 rotate in a counterclockwise direction as viewed in top plan. As guide 64 rotates, the surfaces 96A slide with respect to the surfaces 78A so that O-ring 66 is maintained in compression to inhibit relative rotation between the stock supply reel 40 and the guide 64. Accordingly, tension in the ribbon stock R increases due to the forces exerted thereon by coil spring 62 acting through radial end 62A thereof, pin 102, guide 64 and roller 44.

Figure 6:
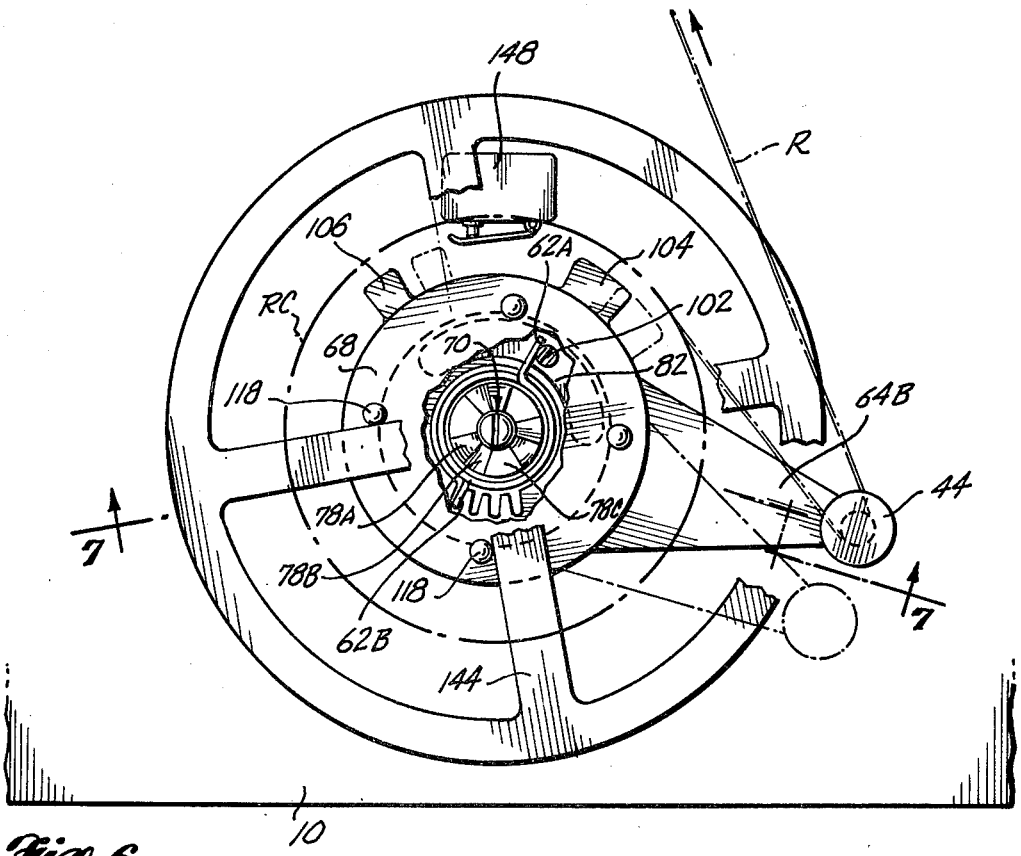
FIG. 6 is a top plan view of the improved tensioning apparatus, under a condition of substantially constant tape tension.

Reel 40 remains locked to guide 64 until guide 64 has reached a second angular position, indicated by the dashed lines in FIG. 6, at which the surfaces 96A come out of contact with surfaces 78A and the inclined surfaces 96B come into contact with the inclined surfaces 78B. The angular separation between the rest and second angular positions of the guide 64, or, the range of "low tension" angular positions thereof, is determined by the radial angles subtended by the surfaces 96A and 78A, and the location of those surfaces relative to the pin 86 and the arcuate aperture 98 determining the rest position. By way of example only, this angular separation may be on the order of 15°. A limit switch 148 (FIG. 4) is mounted on the base plate 10 and located so that its actuating arm is engaged by the nib 106 throughout the range of "low tension" angular positions of guide 64 in order to provide an electrical output signal representing a "low tension" condition in the ribbon stock R.

Further rotation of the drive capstan 50 causes the guide 64 to rotate beyond its second angular position, with the result that guide 64 progressively moves toward the base 60 and away from the reel support disc 68 due to engagement of the inclined surfaces 96B, 78B, as particularly illustrated in FIG. 7. Accordingly, the O-ring 66 is decompressed to progressively reduce the braking force applied thereby to the reel support disc 68. The guide 64 continues to rotate and the tension in the ribbon stock continues to increase, however, until an equilibrium position is reached, as indicated by the solid line portion of FIG. 6, at which the force exerted on the ribbon stock R resulting from the spring 62 balances the force exerted on the ribbon stock R resulting from the braking forces acting through reel support disc 68 and stock supply reel 40. At this equilibrium position, the stock supply reel 40 rotates relative to the guide 64 so that the ribbon stock R can be drawn from the stock supply reel 40. Those skilled in the art will appreciate that the tensioning apparatus will thereafter attempt to maintain a substantially constant tension in the ribbon stock R, by modulation of the braking force applied to reel support disc 68 through compression and decompression of the O-ring 66 as the guide 64 is moved to and from the base 60 due to the interaction of the inclined surfaces 96B, 78B.

The angular range of the guide 64 over which modulation of the braking force applied to the reel support disc 68 occurs is determined by the radial angle subtended by either of the surfaces 96B, 78B, and in the example given is 30°. The substantially constant value of tension that the tensioning apparatus seeks to maintain in the ribbon stock R may be varied by appropriate choice of the size and material of the O-ring 66, the material of the reel support disc 68, the amount that the O-ring 66 is compressed when the guide 64 is in its rest position, the slope of the inclined surfaces 96B, 78B, and the strength of the coil spring 62. In most practical applications, the choice of the substantially constant tension value will be made by varying the strength of the coil spring 62. In this regard, it should be noted that the radial end 62B of the coil spring 62 can be placed in any one of the notches 84 to accordingly vary the force exerted by the coil spring 62 on the guide 64.

A situation may occur in which the ribbon stock R fails to move around the roller 44 even though the guide 64 has rotated beyond its second angular position. For example, the stock supply reel 40 may have been improperly installed on the tensioning apparatus, or, more likely, the ribbon stock R will have been completely drawn out from but still remain attached to the stock supply reel 40. In such a situation, the guide 64 continues to rotate from its second angular position throughout its range of "substantially constant tension" angular positions to a third angular position, as illustrated in FIG. 8, at which the surfaces 96A and 96C of the guide 64 come into contact with the surfaces 78C and 78A, respectively, of the base 60, as illustrated in FIG. 9. As guide 64 continues to rotate from its third angular position throughout its range of "high tension" angular positions, the guide 64 is maintained at a fixed distance from the base 60 to permit the reel support disc 68 to rotate independently of guide 64, and the limit switch 148 is actuated by the nib 104 to provide an electrical signal indicating a "high tension" condition in the ribbon stock R. Conversely, if the ribbon stock R should break, the guide 64 will return to its rest position so that limit switch 148 is actuated by the nib 106 to indicate a "low tension" condition in the ribbon stock R.

Although the invention has been described with reference to a preferred embodiment, those skilled in the art will appreciate that the invention is not limited thereto. For example, the radial angles subtended by the surfaces 96A, 96B, and 96C and the surfaces 78A, 78B and 78C are not critical and are determined by the geometry of the impact printer with which the tensioning apparatus is used. It will also be recognized that the primary functions of the surfaces 96A, 96C and the surfaces 78A, 78C is to provide a range of defined low tension and high tension positions for the guide 64. If such surfaces were not provided, then hysteresis in the components of the tensioning apparatus, including the coil spring 62 and the O-ring 66, would cause the angular positions of guide 64 at which the reel 40 is permitted first to rotate relative to the roller support 64 and second to rotate independently of the guide 64 to vary, therefore making it difficult to detect low tension and high tension conditions in the ribbon stock R. If the detection of such conditions is not required, then surfaces 96A, 96C and surfaces 78A and 78C may be dispensed with. As another example, it is also not required that the reel support disc 68 be supported at a fixed distance above the base 60. Accordingly, the central projectin 112 of reel support disc 68 may be eliminated, so that the reel support disc 68 is capable of moving to and from base 60 along with guide 64. In such a case, the tensioning apparatus will provide acceptable operation most applications, inasmuch as the compression of O-ring 66 will still vary upon rotation of guide 64. Therefore, the scope of present invention is to be interpreted only in conjunction with the appended claims.

The embodiments of the invention in which an exclusive property or privilege is claimed are defined as follows:

1. An apparatus for dispensing tape from a spool thereof and for regulating the tension in the tape so dispensed at a substantially constant value, said apparatus comprising:

first means adapted to receive said spool, said first means being supported for rotation about a first axis;

second means supported for rotation about a second axis which is proximate to and substantially parallel to said first axis, said second means including a tape guide which is adapted to engage a portion of the tape exiting from said spool, whereby said second means may be caused to rotate in a predetermined direction about said second axis by forces exerted on the tape which tend to draw the tape from said first means;

third means exerting a rotational force on said second means so as to yieldably bias said second means to a predetermined angular position thereof;

a compressible, resilient member located between said first means and said second means so as to be capable of being compressed therebetween;

fourth means for varying the displacement between said first means and said second means, in an axial direction substantially parallel to said first and second axes, as the angular position of said second means is varied, said displacement being at a minimum when said second means is at said predetermined angular position so that said compressible, resilient member is fully compressed to substantially inhibit rotation of said first means relative to said second means, said displacement progressively increasing as said second means is caused to rotate away from said predetermined angular position as that said compressible, resilient member is progressively decompressed to permit rotation of said first means relative to said second means.

2. An apparatus as recited in claim 1, wherein said first and said second axes are coaxial.

3. An apparatus as recited in claim 1, wherein said first means has a first, substantially planar surface which is transverse to said first axis, and said second means has a second, substantially planar surface which is transverse to said second axis and which opposes said first, substantially planar surface; and, wherein said compressible resilient member is located between and adapted to be compressed by said first and second, substantially planar surfaces.

4. An apparatus as recited in claim 1 wherein:
said first and second axes are coaxial;
one of said first and said second means has a substantially planar surface which is transverse to said first and said second axes;
the other of said first and said second means has a substantially annular groove which is transverse to said first and said second axes and which opposes said substantially planar surface; and,
said compressible, resilient member comprises an O-ring contained within and projecting beyond said substantially annular groove.

5. An appartus as recited in claim 1, wherein said fourth means includes: means constraining said first means from moving more than a predetermined elevation in said axial direction; first and second, contacting, opposing surfaces for varying the elevation of said second means in said axial direction, said first surface being joined to and rotatable with said second means, and said second surface having a fixed elevation in said axial direction, at least one of said first and said second surfaces sloping away from said first means in said predetermined direction of rotation of said second means from said predetermined angular position.

6. An apparatus as recited in claim 5, wherein said first and second, contacting, opposing surfaces are complementary and each slope away from said first means in said predetermined direction of rotation.

7. An apparatus as recited in claim 6, wherein said first and second, contacting, opposing surfaces are each substantially planar.

8. An apparatus, useful in printing apparatus, for supporting a spool of print or ribbon stock for rotation, and for regulating tension in said stock as a force is exerted thereon by the printing apparatus to draw said stock from said spool, said apparatus comprising:

(a) a base adapted to be secured to the printing apparatus, said base including means defining an axis of rotation, and also having a first surface projecting from said base which inclines toward said base in a predetermined direction of rotation about said axis;

(b) a stock guide means including a central portion, an arm extending from said central portion, and a guide secured to said arm, said stock guide means being supported for rotation about said axis and having a second surface projecting from said central portion thereof which rests on said first surface of said base and which includes away from said central portion in said predetermined direction of rotation about said axis, said first and said second surfaces being located relative to each other so that when said stock guide means is at a predetermined angular position thereof, said stock guide means is maintained at a maximum elevation above said base, whereby said stock guide means moves toward said base as said stock guide means is rotated in said predetermined direction;

(c) means yieldably biasing said stock guide means to said predetermined angular position;

(d) a reel means supported for rotation about said axis independent of said stock guide means, said reel means being adapted to receive said spool, with said stock exiting from said spool when drawn therefrom and passing around said guide of said stock guide means, said reel means being constrained from moving more than a predetermined elevation above said base; and, (e) a compressible, resilient member located between said stock guide means and reel means, said compressible, resilient member being fully compressed between said stock guide means and said reel means when said stock guide means is in said predetermined angular position to inhibit relative rotation between said reel means and said stock guide means, and being progressively decompressed as said stock guide means is rotated in said predetermined direction and moves toward said base to permit relative rotation between said reel means and said stock guide means.

9. An apparatus as recited in claim 8, wherein said first and said second surfaces are each substantially planar, and wherein each subtend a predetermined radial angle less than 360°.

10. An apparatus as recited in claim 8, further comprising a third surface projecting from said base and adjoining said first surface in a direction of rotation about said axis opposite to said predetermined direction, said third surface being substantially planar, being perpendicular to said axis of rotation, and having an elevation above said base which is substantially equal to a maximum elevation of said first surface; and, a fourth surface projecting from said central portion of said stock guide means and adjoining said second surface in said predetermined direction of rotation about said axis, said fourth surface being substantially planar, being perpendicular to said axis of said rotation, and having an elevation above said central portion which is substantially equal to a maximum elevation of said second surface, whereupon rotation of said stock guide means through a first range of angular positions results in said fourth surface resting on said third surface to maintain said stock guide means at said maximum elevation above said base, and rotation of said stock guide means through a second range of angular positions results in said second surface resting upon said first surface to vary the elevation of said stock guide means with respect to said base.

11. An apparatus as recited in claim 10, further comprising a fifth surface projecting from said base and adjoining said first surface in said predetermined direction of rotation about said axis, said fifth surface being substantially planar, being perpendicular to said axis of rotation, and having an elevation above said base which is substantially equal to a minimum elevation of said first surface; and, a sixth surface projecting from said central portion of said stock guide means and adjoining said second surface in a direction of rotation about said axis opposite to said predetermined direction, said sixth surface being substantially planar, being perpendicular to said axis of rotation, and having an elevation above said central portion which is substantially equal to a minimum elevation of said second surface, whereupon rotation of said stock guide means through a third range of angular positions results in said sixth surface resting upon said third surface and said fourth surface resting upon said fifth surface to maintain said stock guide means at a minimum elevation above said base.

12. An apparatus as recited in claim 11, further commprising means for indicating when said stock guide means is in said first range of angular positions and in said third range of angular positions.

13. An apparatus as recited in claim 8, wherein said reel means includes: a reel support disc rotatable about said axis and having a substantially planar surface engaging said compressible, resilient member; a shaft coaxial with said axis of rotation; a reel rotatably supported on said shaft and resting on said reel support disc, said reel being adapted to receive said spool; and, means for transmitting rotational forces between said reel support disc and said reel.

14. An apparatus as recited in claim 13, further including means for maintaining said reel support disc at said predetermined elevation above said base.

15. An apparatus as recited in claim 8, wherein:

said reel means has a substantially planar surface which is perpendicular to said axis of rotation;

said stock guide means has a substantially annular groove therein which is perpendicular to said axis of rotation and which opposes said substantially planar surface of said reel means; and, said compressible, resilient member comprises an O-ring contained within and projecting beyond said substantially annular groove.

16. An apparatus as recited in claim 8, wherein said means for yieldably biasing said stock guide means comprises a coil spring located between said stock guide means and said base, said coil spring having a first radial end bearing on said stock guide means and a secnd radial end bearing on said base.

* * * * *